United States Patent [19]

Bogucki-Land

[11] Patent Number: 4,525,905

[45] Date of Patent: Jul. 2, 1985

[54] APPARATUS FOR BEAMING ELASTIC THREADS

[75] Inventor: Bogdan Bogucki-Land, Offenbach, Fed. Rep. of Germany

[73] Assignee: Karl Mayer Textilmaschinenfabrik GmbH, Obertshausen, Fed. Rep. of Germany

[21] Appl. No.: 398,380

[22] Filed: Jul. 14, 1982

[30] Foreign Application Priority Data

Jul. 18, 1981 [DE] Fed. Rep. of Germany ..... 3128538

[51] Int. Cl.[3] ..... D02H 13/14

[52] U.S. Cl. ..... 28/185; 28/194; 28/241

[58] Field of Search ..... 28/185, 194, 241

[56] References Cited

U.S. PATENT DOCUMENTS

| | | | |
|---|---|---|---|
| 1,797,391 | 3/1931 | Abbott | 28/185 |
| 2,160,910 | 6/1939 | Runton | 28/194 X |
| 2,169,886 | 8/1939 | Shaw | 28/194 |
| 2,534,340 | 12/1950 | Chaya et al. | 28/172 |
| 2,956,328 | 10/1960 | Faw | 28/194 X |
| 3,015,871 | 1/1962 | Noe | 28/185 |
| 3,045,360 | 7/1962 | Alexeff et al. | 28/185 X |
| 3,481,011 | 12/1969 | Norton | 28/185 |
| 4,137,614 | 2/1979 | Wolstencroft | 28/172 |

FOREIGN PATENT DOCUMENTS

| | | | |
|---|---|---|---|
| 742144 | 12/1955 | United Kingdom | 28/185 |
| 914675 | 3/1982 | U.S.S.R. | 28/194 |

*Primary Examiner*—Robert R. Mackey
*Attorney, Agent, or Firm*—Omri M. Behr

[57] ABSTRACT

The arrangement can transfer with respect to a beam, elastic threads having a predetermined initial extension. The arrangement has a first device for imparting a first thread speed to the threads being transferred. Also included is a controller and at least one tension roller, the latter rotatably mounted between the beam and the first device. The roller can impart a second thread speed to the threads and can stretch them. The threads at the beam are transferred at a third thread speed. Among the first, second and third thread speeds the two furthest upstream have an adjustable speed ratio. The controller can measure the tension of the threads traveling to the tension roller. This controller is operable to alter the speed ratio in response to the tension of the threads, to hold this tension at a predetermined magnitude.

6 Claims, 4 Drawing Figures

Fig. 1A
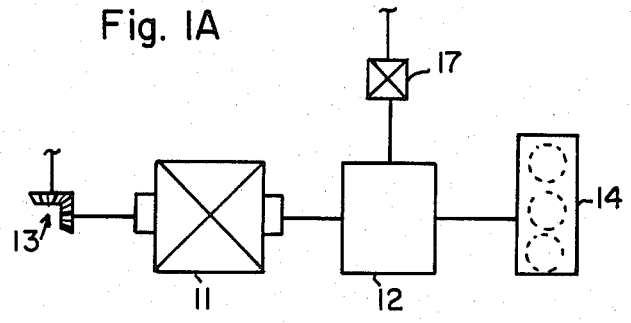
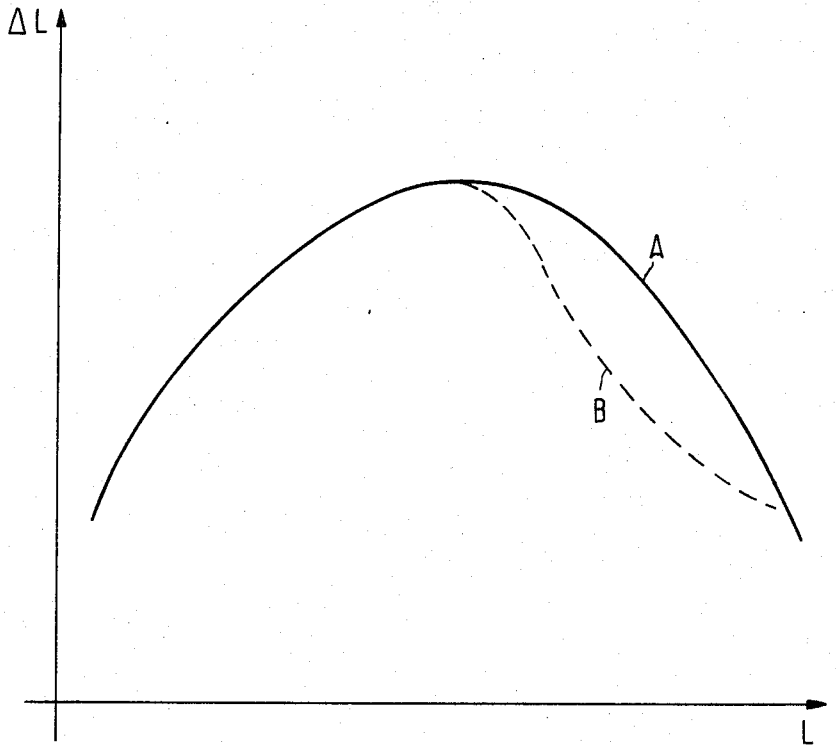
Fig. 3

APPARATUS FOR BEAMING ELASTIC THREADS

BACKGROUND OF THE INVENTION

1. Field of the Invention

The present invention relates to winding arrangements such as warp beams for the warping of elastic thread having predetermined extensions. Thread paid out from a spool of a creel is driven by payout rollers driven at a first predetermined circumferential speed, are stretched by means of tension rollers driven at a higher, second, predetermined circumferential speed before being finally warped onto a warp beam driven on a warping machine at a third circumferential speed of the warp beam wind. In this apparatus, the relationship between two sequential winding speeds is constant and their relationship to the other circumferential winding speed is alterable in dependence upon an operational quantity.

2. Discussion of the Relevant Art

In a warping arrangement of this type (LIBA 22E), the payout rollers and the tensioning rollers are driven at a constant speed so that the relationship between the first and the second circumferential speeds is constant. The warping machine is so driven that for a circumferential speed of the warp beam wind, for a given degree of stretch, a compensation is provided to thread taken from the creel in dependence upon the length of the thread, by means of a compensating eccentric cam.

In this respect, one must face the fact that elastic threads are not wound on their spools with constant tension in relationship to the thread length. The tension difference can run as high as 10% and it is not permissible to transfer this difference to a warp beam because then, with the same length of thread on the warp beam, different diameters are obtained. A compensating eccentric cam is unfortunately suited only for a particular spool size and a particular thread number. Where different spools are used it is necessary to provide a different compensating cam. If the situation arises where the spools are of a type not previously used, it is necessary to manufacture a new compensating eccentric cam. This requires the need for time consuming experimentation to obtain the proper form. With this type of compensation, it is also not possible to warp the threads with constant tension since the compensating eccentric cam can only provide for an average tension compensation and tension changes which occur during prolonged machine rest periods are not taken into account at all.

It is further known (DE-GM No. 6929186) to take off single threads over a slidingly coupled, driven spool and despite changing payout speeds, maintain a constant tension in that the spool is braked in dependence upon the tension of its individual thread. For this purpose there is provided a rotatable moment balance which carries a roller on each arm of a twin armed lever. This lever is biased by a braking spring so that the forces working on the thread lies in the order of magnitude of the braking spring force.

Accordingly, there is a need for a warping or similar arrangement of the foregoing type wherein the warping on the warp beam is achievable with higher extension accuracy and without the need for a compensating eccentric cam.

SUMMARY OF THE INVENTION

An arrangement according to the principles of the present invention can transfer with respect to a beam, elastic threads having a predetermined initial extension. The arrangement has a first device for imparting a first thread speed to the threads being transferred. Also included is a controller and at least one tension roller, the latter rotatably mounted between the beam and the first device. This above roller can impart a second thread speed to the threads and can stretch them. The threads at the beam are transferred at a third thread speed. Among the first, second and third thread speeds the two furthest upstream have an adjustable speed ratio. The controller can measure the tension of the threads traveling to the tension roller. This controller is operable to alter the speed ratio in response to the tension of the threads, to hold this tension at a predetermined magnitude.

With equipment of the foregoing type, a measuring device can measure the tension of all of the threads between the payout rollers and the tensioning rollers. The relationship between the first and second circumferential speeds can be controlled in dependence upon the measuring, resulting in constant tension.

In such an arrangement, the tension between the payout rollers and the tension rollers may be kept constant. Similar tension, however, means similar extension. In a preferred embodiment, the thread is wound on a warp beam. Since the circumferential wind speed at the warp beam is in constant relationship to the circumferential speed on the tensioning rollers, the threads are warped with an even tension.

It is also preferred to provide that the measuring arrangement is a rotary moment balance which comprises a roller for all of the threads on each side of the axis of rotation and is biased by a set-value spring so that a control circuit can alter the control drive when the rotational moment balance finds itself outside a predetermined position.

BRIEF DESCRIPTION OF THE DRAWINGS

In order that the invention may be more fully understood, it will now be described, by way of example, with reference to the accompanying drawings in which:

FIG. 1A is a partial, schematic representation of an arrangement that is an alternate to that of FIG. 1;

FIG. 3 is a graph of the extension on the spool of spooled thread in dependence upon the length of the thread itself.

DESCRIPTION OF THE PREFERRED EMBODIMENT

Figure 1:
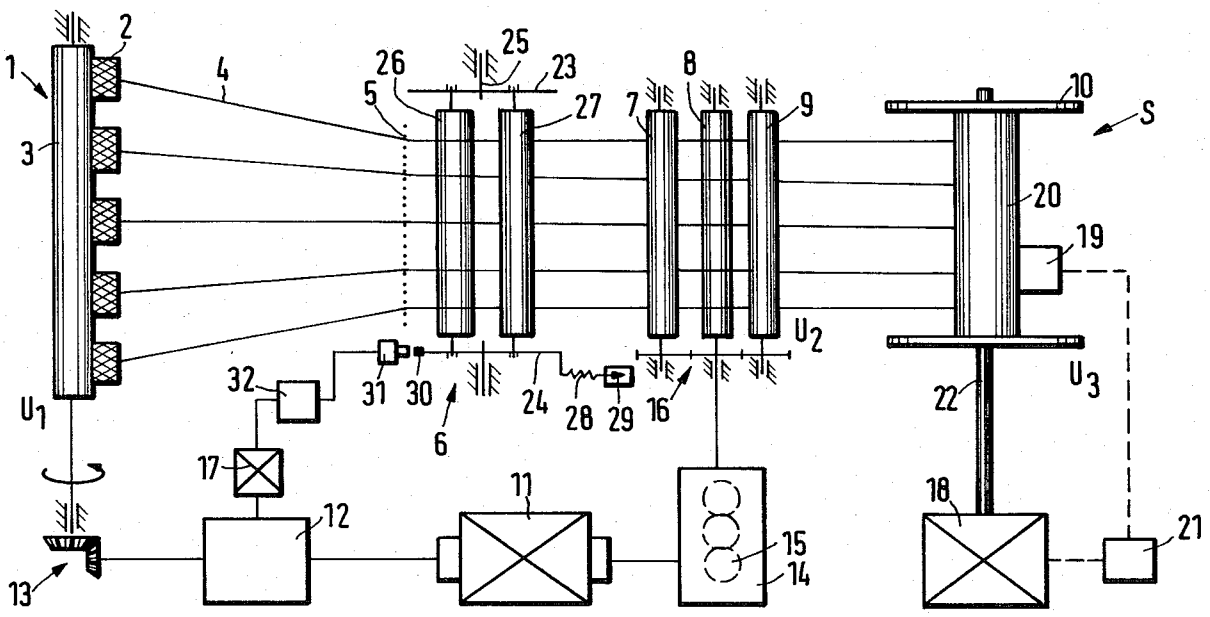
FIG. 1 is a plan, schematic representation of an arrangement of the present invention.

In the warping arrangement of FIG. 1, there is provided a creel 1 containing a plurality of spools 2 of which only a few spools are shown. These spools are driven by a first means, shown herein as a pay out roller 3 having an axis of rotation parallel to spools 2. The elastic threads from spools 2, which are either made of rubber or elasthane, thereafter pass through the apertures of collecting gate 5, then through a portion of a control means shown herein as measuring arrangement 6 for measuring the thread tension. Subsequently, threads 4 pass through an arrangement with driven tension rollers 7, 8 and 9 and finally are warped onto warp beam 10 of warping machine S. Rollers 7, 8 and 9 are mounted to rotate about fixed parallel axes. The axis of roller 8 is higher than the others which are of the same height. A common drive motor 11 drives the payout roller 3 via control arrangement 12 which drives angled drive 13. Motor 11 drives the tension rollers 7, 8 and 9 via a drive means 14 provided with change wheels 15. Drive means 14 synchronously drives rollers 7, 8 and 9 through spur gear drive 16.

The control drive 12 may be a differential or planetary drive whose output speed is regulated by a setting motor 17 coupled thereto. Motor 17 can be a motor whose speed or position is readily controlled, depending upon the nature of control drive 12. Warp beam 10 is driven by another motor 18. A feeler arrangement 19 moves against and determines preferably the circumferential speed of winding 20 on beam 10 (alternatively diameter or circumference could be measured), for example, by means of a contact roller. A signal from feeler 19 controls the number of revolutions of output shaft 22 of motor 18 by means of controller 21 so that the circumferential speed of the winding 20 remains constant.

As an example, controller 21 can vary the D.C. operating potential of motor 18 to control its speed. Thus, with the assistance of control means 12, a controllable circumferential speed UI is provided to payout rollers 3 and a constant circumferential speed U2 is provided for tension rollers 7, 8 and 9 by motor 11 running at a constant speed. Of course the speed of rollers 7, 8 and 9 can be discretely adjusted by means of change wheels 15. Finally, a constant circumferential speed U3 is provided at the circumference of winding 20. While speed U1 is varied in this embodiment, speed U2 can be varied instead to produce the same variation in the speed ratio U1/U2. Alternatively, all speeds U1, U2 and U3 can be adjusted to produce stretching in one or more adjustable stages. It is preferred, however, that the payout rollers, and the tensioning rollers 7, 8 and 9 are served by a common drive motor to drive one of these rollers at a constant speed and the others via a control drive. By use of such a control drive arrangement, it is possible to readily alter the relationships or ratio between the circumferential speeds.

Measuring arrangement 6 is provided as a rotational movement balance in the form of a frame comprising two discs 23 and 24 which are rotatable about their common central axis 25. Spanning and supported by these discs are rollers 26 and 27 positioned on opposite sides of central axis 25. The axes of rollers 26 and 27 are preferably equidistant from and parallel to axis 25. Rollers 26 and 27 biased by a bias means in the form of a rated-value spring 28 connected to the perimeter of disc 24 and whose spring tension may be altered by means of a rated value setting arrangement 29.

In its simplest form, arrangement 29 may be a screw that pulls on one end of spring 28 to change its tension. Furthermore, disc 24 carries an indicator or indicia 30 which may be registered and whose registeration may be detected by transducer 31 operating through either optical or inductive means. For example, indicia 30 may be a reflective or magnetic element while transducer 31 can comprise a phototransistor or a magnetic detector such as a Hall-effect crystal. The output signal of transducer 31 is led to a control device 32 which influences the setting motor 17. For example, transducer 31 can respond to the magnitude of a detected magnetic signal and its direction (or polarity) to develop an error signal bearing directional information.

By means of the measuring arrangement 6, the tension of threads 4 running therethrough is constantly measured and compared to the force exercised by the rated value spring 28. When during the warping step, the thread tension alters because of decreasing diameter of spools 2, for example, the measuring arrangement 6 becomes unbalanced. The transducer 31 detects this change and signals control device 32 to operate setting motor 17 and run control drive 32 until the measuring arrangement 6 is in balance again. By means of the resetting of control drive 12, the payout speed of payout rollers 3 is altered in accordance with measured errors in thread tension. At higher thread tensions, the rollers 3 run faster, at lower tensions they run slower. In this way all errors may be smoothed out in consequence of uneven tensions of the elastic threads found on spool 2.

In FIG. 3, there is shown the extension $\Delta L$ corresponding to the amount of longitudinal stretching as a function of the length L of thread originally wound and remaining on a spool. This extension is less on a full spool (at the left in FIG. 3), increases up to about 10% on a half full spool and then decreases to a smaller value as the spool becomes empty. This typical sequence is illustrated by the solid-line curve A. The dashed curve B can occur when the warping arrangement is permitted to stand at rest after taking off approximately half the spool content. It will be noticed that the magnitude of extension $\Delta L$ drops as a result and without compensation would cause a relatively looser wind on the warp beam. All of these tension inconsistencies are automatically smoothed out on the aforementioned stretching arrangement. For example, it may be desirable to hold a constant extension of about 80% between payout rollers 3 and tension rollers 7, 8 and 9. Afterwards, this extension can, for example, be reduced to a value of about 40% on the warp beam 10 and held at that value. The motors 11 and 18 are electric motors and are suitably DC motors. It is possible to set the speed of rotation of motor 11 to yield a basic payout speed.

Figure 2:
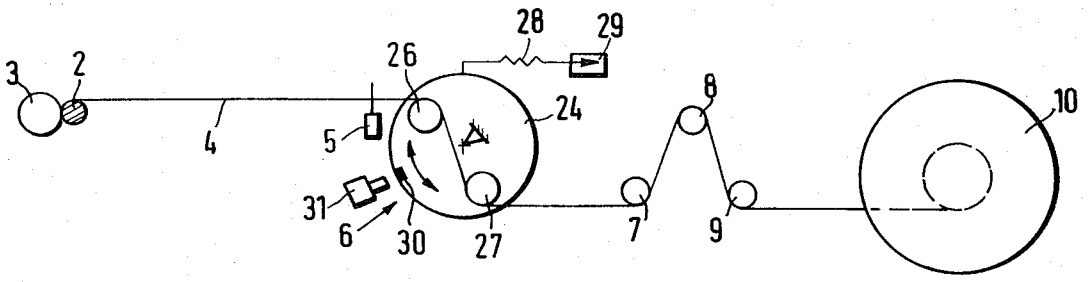
FIG. 2 is a side elevational view of the arrangement of FIG. 1.

In operation, in a warping arrangement for the warping of elastic threads with predetermined stretching, threads 4 are taken from a spool in the creel 1 by a payout roller 3 having a circumferential speed UI and are stretched by a further set of tension rollers 7, 8 and 9 having a higher circumferential speed of U2. Finally, threads 4 are warped onto the warp beam wind 20 of a warp knitting machine S at a circumferential speed of U3. Since motor 11 and 18 operate at a constant speed, driving rollers 7, 8 and 9 and warp beam 20, the relationship between the two sequentially following circumferential speeds U2 and U3 is constant. However, the relationship between the other two sequential, circumferential speeds U1 and U2 is alterable depending upon thread tension. The measuring device 6 between the payout roller 3 and the tension rollers 7, 8 and 9 determines the tension of all threads 4. The relationship between the first and the second circumferential speeds U1 and U2 is controllable as a result of the measuring which tends to keep the tension constant. Assume that due to a variation in the extension of thread 4 in its spool 2, thread tension decreases. As a result, the torque applied to discs 23 and 24 through rollers 26 and 27 decreases. Consequently, spring 28 is able to rotate discs 23 and 24 clockwise, as viewed in FIG. 2. In response, indicia 30 is misaligned with transducer 31 which produces an error signal signifying insufficient thread tension. It is advantageous to provide rotational moment balance 6 with marker 30 to influence the feeler 31 in a contactless manner. Thus, even very small changes from the preset position give rise to reaction in the control circuit 32 so that a very rapid and exact compensation of the tension of the elastic threads may be thus provided. This signal is conveyed through circuit 32 to energize setting motor 17. Motor 17 adjusts controller 12 to reduce its speed ratio, causing roller 3 to move more slowly. In practice, it is sufficient that the control arrangement 12 has an operative range of 10% since this is adequate to even out the usual thread tension differences. It is very simple to achieve this end by utilizing differential or planetary drive as the control drive. Since thread 4 is thus paid out more slowly, its tension increases thereby overcoming spring 28 and driving indicia 30 into alignment with transducer 31. Once alignment is achieved, motor 17 no longer changes the speed ratio of controller 12 and roller 3 maintains its new speed. Obviously, the foregoing process could be reversed so that an increase in thread tension causes payout rollers 3 to increase in speed.

By use of a payout roller, the often rather substantial tension is not transferred to the spools. On the other hand, the changing extensions which occur over the length of the threads on the spools whether caused by normal circumstances or not, are always detected by the measuring arrangement and compensated for by control of the circumferential speeds.

Referring to FIG. 1A, it shows the previously illustrated elements 11, 12, 13, 14, and 17, in a partial schematic. The coupling between the components has been changed however. Motor 11 now drives level gears 13 directly but drives gear train 14 through control drive 12. As before motor 17 is used to adjust the output speed of control drive 12. The operation is as before except that with this arrangement, the speed U1 (FIG. 1) can be held constant while speed U2 is varied.

While it is advantageous to control the drive speed of the payout roller to simplify the complexity of the control mechanism, other speeds such as that of the tension rollers can be altered instead. While two speeds can be varied it is preferable that the circumferential speed of either the tensioning or payout rollers be set to a constant and therefore it is merely necessary to provide for a constant circumferential speed of the wind on the warping machine.

It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what I claim is:

1. An arrangement for transferring with respect to a beam elastic threads having a predetermined initial extension comprising:

a spool creel having a plurality of spools for carrying said elastic threads;

first means for engaging and driving said spools to impart a first thread speed to said threads being transferred, said first means including at least one payout roller coupled to said spools for delivering said thread at a circumferential speed corresponding to said first speed;

at least one tension roller rotatably mounted between said beam and said first means for imparting a second thread speed to said threads and for stretching them; and drive means coupled to said first means and said tension roller for driving them, said drive means being operable to provide adjustable speeds, said first and second thread speeds being provided with an adjustable speed ratio by said drive means, said drive means including:

control means for measuring the tension of the threads traveling to said tension roller, said control means including means for adjusting the speed ratio between said first and second speeds, said control means being coupled to said drive means and through it being operable to alter said speed ratio in response to the tension of said threads, to hold said tension at a predetermined magnitude; and a speed controller having a constant speed motor, and variable means having an input and output for converting speed therebetween, said motor and said variable means each having an output shaft, the output shaft of said variable means being powered by said motor to a speed varying from that of said motor, said payout roller and tension roller each being driven by a different corresponding one of said output shafts.

2. An arrangement according to claim 1 wherein said variable means comprises a differential drive having one input driven by said motor.

3. An arrangement according to claim 1 wherein said variable means comprises a planetary drive having an input driven by said motor.

4. An arrangement for transferring with respect to a beam elastic threads having a predetermined initial extension comprising:

a spool creel having a plurality of spools for carrying said elastic threads;

first means for engaging and driving said spools to impart a first thread speed to said threads being transferred, said first means including at least one payout roller coupled to said spools for delivering said thread at a circumferential speed corresponding to said first speed;

at least one tension roller rotatably mounted between said beam and said first means for imparting a second thread speed to said threads and for stretching them; and drive means coupled to said first means and said tension roller for driving them, said drive means being operable to provide adjustable speeds, said first and second thread speeds being provided with an adjustable speed ratio by said drive means, said drive means including:

control means for measuring the tension of the threads traveling to said tension roller, said control means including means for adjusting the speed ratio between said first and second speeds, said control means being coupled to said drive means and through it being operable to alter said speed ratio in response to the tension of said threads, to hold said tension at a predetermined magnitude;

at least one balance roller;

a frame supporting said balance roller, said frame and balance roller being rotatable in the same direction about spaced axes;

bias means for rotating said frame in a predetermined direction to urge said roller against said threads; and transducer means coupled to said control means for providing thereto a position signal responsive to positioning of said frame, said control means being operable to adjust said adjustable speed ratio in response to said position signal.

5. An arrangement according to claim 4 wherein said at least one balance roller comprises two spaced balance rollers each mounted on opposite sides of said frame and its axis of rotation, said threads passing between the two rollers, said control means being operable to alter said speed ratio to hold said frame at a predetermined angular position.

6. An arrangement according to claim 5 wherein said frame carries an indicia and wherein said transducer means comprises:

a transducer mounted alongside said frame and responsive to its indicia to produce an error signal signifying the displacement of said indicia from a predetermined position, said transducer operating without contacting said indicia.

* * * * *